US008773287B2

(12) United States Patent
Zettergren et al.

(10) Patent No.: US 8,773,287 B2
(45) Date of Patent: Jul. 8, 2014

(54) DEVICE AND METHOD FOR TRAFFIC SURVEILLANCE

(75) Inventors: Fredrik Zettergren, Uppsala (SE); Patrik Söderberg, Uppsala (SE); Karl Nilvér, Stockholm (SE); David Kulander, Uppsala (SE)

(73) Assignee: Sensebit AB, Uppsala (SE)

( * ) Notice: Subject to any disclaimer, the term of this patent is extended or adjusted under 35 U.S.C. 154(b) by 741 days.

(21) Appl. No.: 13/055,789

(22) PCT Filed: Mar. 29, 2010

(86) PCT No.: PCT/SE2010/050345

§ 371 (c)(1),
(2), (4) Date: Jan. 25, 2011

(87) PCT Pub. No.: WO2010/138057

PCT Pub. Date: Dec. 2, 2010

(65) Prior Publication Data

US 2011/0121995 A1 May 26, 2011

(30) Foreign Application Priority Data

May 28, 2009 (SE) ..... 0950385

(51) Int. Cl.
*G08G 1/01* (2006.01)
*G08G 1/042* (2006.01)

(52) U.S. Cl.
USPC ..... 340/933; 340/941

(58) Field of Classification Search
USPC ..... 340/941, 933
See application file for complete search history.

(56) References Cited

U.S. PATENT DOCUMENTS

| | | | | |
|---|---|---|---|---|
| 5,757,288 | A | 5/1998 | Dixon et al. | |
| 5,877,705 | A | 3/1999 | Sampey | |
| 5,880,682 | A | 3/1999 | Soulliard et al. | |
| 6,583,732 | B1 * | 6/2003 | Bervoets et al. | 340/933 |
| 7,382,282 | B2 * | 6/2008 | Kavaler | 340/941 |
| 2002/0177942 | A1 | 11/2002 | Knaian et al. | |
| 2002/0190856 | A1 | 12/2002 | Howard | |
| 2005/0190077 | A1 | 9/2005 | Kavaler | |
| 2006/0132298 | A1 | 6/2006 | Kavaler | |
| 2010/0044123 | A1 * | 2/2010 | Perlman et al. | 180/2.1 |

* cited by examiner

*Primary Examiner* — Daniel Wu
*Assistant Examiner* — John Bamert
(74) *Attorney, Agent, or Firm* — Birch, Stewart, Kolasch & Birch, LLP

(57) ABSTRACT

A vehicle detector (10) comprises a vehicle sensor (14) arranged for sensing disturbances caused by a vehicle, a digitizer of a microprocessor (20) connected to the vehicle sensor (14). The vehicle detector (10) further comprises a memory (18) connected to the digitizer and arranged for storing the digital representation, an antenna (12) and a transmitter of a radio unit (40). The microprocessor (20) also comprises a controller arranged for controlling operation of the vehicle sensor (14), and the transmitter. The vehicle detector has a housing (49) enclosing the vehicle sensor (14), the digitizer, the memory, the transmitter and the controller. The housing (49) provides protection against mechanical damage and moisture, thereby enabling the housing to be placed under ground. The antenna (12) is provided outside the housing (49) and at a distance from the housing (49) for enabling placement of the antenna (12) within a roadway surface coating.

20 Claims, 8 Drawing Sheets

DEVICE AND METHOD FOR TRAFFIC SURVEILLANCE

TECHNICAL FIELD

The present invention relates in general to devices and methods for traffic surveillance and in particular to devices and methods for sensing motion of vehicles by means of magnetic detection.

BACKGROUND

A large part of the communications today involves the use of autonomously driven vehicles at a common system of roadways. Traffic surveillance has become very important indeed in order to provide for efficient planning of refurnishing or re-construction of roadways as well as to provide for improved safety. There are today many types of control systems for supervision of different types of traffic streams and for many different purposes.

There are systems based on visual surveillance. However, such systems are very expensive and sensitive to wear or damage. Moreover, such systems also require advanced image interpretation in order to enable automatic surveillance. Another system, often used for traffic counting, is to provide flexible tubes over the roadway and monitoring a pressure change in the tubes when a vehicle passes. One disadvantage with such solutions is e.g. their susceptibility for damage and wear, which means that they are unlikely to be used for permanent solutions. Furthermore, the mounting of the equipment may be dangerous, at least at highly busy roads and requires extensive manual operations.

Magnetic sensors are also used for vehicle detection. One simple solution is to provide a loop of electrically conducting material within the roadway surface coating. When a vehicle passes, the vehicle causes disturbances in the earth magnetic field, which in turn causes an induction in the buried loop. A disadvantage of the magnetic loop approach is that it requires relative extensive impact on the roadway surface coating upon installation. Also, if the loop is provided at a relatively shallow depth, it may be destroyed upon wear of the general roadway surface coating. Also in cases where roadway reconditioning is performed, such loops may indeed damage the reconditioning equipment, and have therefore to be removed beforehand.

There are also some prior art traffic sensor system based on different kinds of magnetometers. In the published US patent applications 2005/0190077 and 2006/0132298, methods and apparatuses for vehicular sensors are disclosed. A magnetic sensor using the magnetic resistive effect is provided close to a roadway for sensing a change in magnetic flux when a vehicle passes. The magnetic sensor is comprised in a vehicular sensor node provided at the top of the pavement. A magnetic sensor state is recorded upon the passage of a vehicle and the results are approximated and encoded to be sent to a means for wirelessly receiving. A disadvantage with such a system is that the vehicular sensor node typically is provided on top of the pavement at the side of the roadway, which provides for a relatively weak change in magnetic field. Furthermore, traffic in parallel traffic lanes is difficult to distinguish. Moreover, the vehicular sensor nodes may be susceptible for damage.

In the U.S. Pat. No. 5,877,705, a method and apparatus for analyzing traffic is disclosed. A magnetic sensor is provided buried beneath the road surface and is connected to a data collection computer either via physical conductors or via an RF link to an intermediate roadside receiver. To have physical connections causes problems upon installation, since significant impact has to be provided on the road surface coating causing heavy disturbances in the traffic. This is overcome by using the radio interface. However, in order to reduce the power consumption to allow for battery powering of the sensor, the roadside receiver has to be provided within e.g. 30 meters. This results in that many roadside receivers have to be provided, which increases the cost and the likelihood for damages.

Also the U.S. Pat. No. 5,880,682 discloses a traffic control system based on magnetic sensors buried below the roadway surface asphalt. The sensor is battery powered and communicates with a receiver positioned at the side of the road. This system is intended to be used together with e.g. a traffic control signalling light, where the need for the roadside receiver is not too cumbersome. However, for temporary solutions or for the provision of a multitude of traffic counting locations, the need for the roadside receiver becomes expensive and requires typically the provision of electrical power to the roadside receiver.

In the published patent application US 2002/0177942, a wireless roadway monitoring system is disclosed. A wireless, in-road traffic sensor system uses sensors for measuring e.g. speed of passing vehicles that are small, low-cost, and rugged. The sensor includes a wireless transmitter and may be configured for installation beneath a roadway surface.

A general problem with prior art traffic surveillance detectors is that they are not very well suited for flexible and/or intermittent usage.

SUMMARY

An object of the present invention is to provide vehicle detectors and methods for providing traffic information that are more suitable for flexible and/or intermittent usage. The object is achieved by devices and methods according to the enclosed patent claims. In general words, according to a first aspect, a vehicle detector, comprises a vehicle sensor arranged for sensing disturbances caused by a vehicle, a digitizer connected to the vehicle sensor. The digitizer is arranged for encoding a signal from the vehicle sensor into a digital representation. The vehicle detector further comprises a memory connected to the digitizer and arranged for storing the digital representation, an antenna and a transmitter connected to the memory and the antenna. The vehicle detector also comprises a controller arranged for controlling operation of the vehicle sensor, the digitizer, the memory and the transmitter. The vehicle detector has a housing enclosing the vehicle sensor, the digitizer, the memory, the transmitter and the controller. The vehicle detector also comprises a battery powering the vehicle sensor, the transmitter and the receiver. The housing provides protection against mechanical damage and moisture for the vehicle sensor, the digitizer, the memory, the transmitter and the controller, thereby enabling the housing to be placed under ground. The antenna is, however, provided outside the housing and at a distance from the housing for enabling placement of the antenna within a roadway surface coating. The controller is arranged for turning off the transmitter, the receiver, and/or the vehicle sensor during a predetermined inactivity period and for activating the transmitter and the receiver and transmitting a request for further instructions when the inactivity period is ended.

According to a second aspect, a method for providing traffic information comprises sensing of disturbances caused by a vehicle, digitalizing of signals of the disturbances into a digital representation, storing the digital representation and transmitting signals to a traffic surveillance node by use of radio signals. The sensing, digitalizing and storing are performed in a device placed under ground, while the transmitting comprises providing of the signals to be transmitted over a distance to an antenna placed within a roadway surface coating. The performing of the steps of sensing disturbances, transmitting signals and receiving signals is disabled during a predetermined inactivity period and the step of transmitting signals and transmitting a request for further instructions are performed when the inactivity period is ended.

One advantage with the present invention is that it enables an improved flexibility in the usage of vehicle detectors, since the vehicle detectors can make use of already existing public mobile telecommunication networks as communication resources directly from the vehicle detectors. Other advantages are described in connection with different features in the detailed description further below.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference numbers are used for similar or corresponding elements.

When detecting changes in the earth magnetic field caused by a passing vehicle, it is of importance how the detectors are positioned relative to the path of the vehicle. If a detector is positioned at the sides of a road, it might be difficult to discriminate between traffic in different lanes or in different directions. The most beneficial positions for detectors for vehicle detection purposes are above or below the vehicle path. To mount the vehicle detectors above the traffic is expensive and complex and is only a realistic alternative when e.g. sophisticated optical detection is utilized. For most systems, the detectors are preferably positioned below the traffic.

One alternative to place the detectors is to put them on top of or within the surface of the roadway surface coating. However, such a position is extremely exposed for wear and damage. Unless the wheel tracks are defined to be situated besides the detector positions, there is always a risk that the vehicles will run straight over the detectors, causing extensive mechanical stress as well as wear. In climates where snow is likely to occur, the road surfaces are often scraped, which further increases the risk of damage to the detectors.

If the detectors are covered with some kind of protection coverage, further disadvantages remain. The wear of roadways is typically relatively high, and the protection coverage has to be relatively thick to withstand such normal wear. Furthermore, due to the wear, roadways are repaved occasionally. In connection therewith, it is common to remove the uppermost part of the still existing roadway surface coating to even out the roadway surface and to produce a surface that is suitable to repave. If vehicle detectors are present within the surface coating, both the detectors and the road-making machine may be damaged.

Figure 1A:
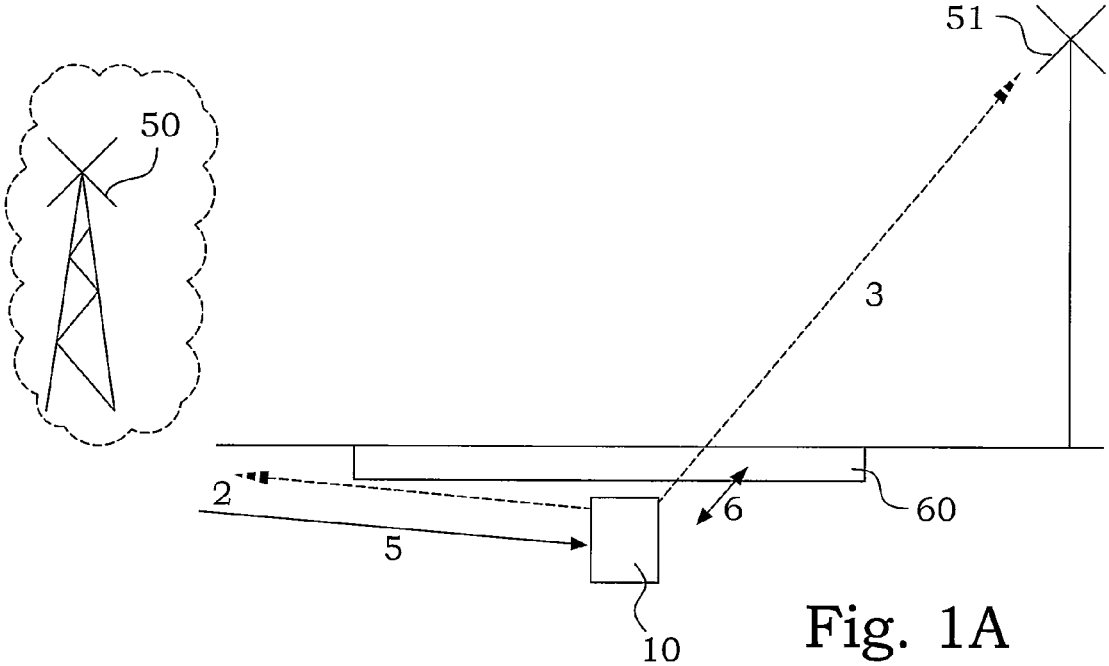
FIG. 1A is a block scheme of embodiments of prior art vehicle detector systems.

The solution to this problem is to bury the detectors deep enough for avoid to interact with the road-making machines. Such a situation is illustrated in FIG. 1A. A vehicle detector 10 is placed under ground below a roadway surface coating 60 or buried deep in a roadway surface coating 60. The detector 10 is placed close enough to the surface to still being able to detect when a vehicle passes on top of the roadway surface coating 60.

Communication between the vehicle detector 10 and any external control system can be arranged in different ways, e.g. by cables or by radio communications. In most cases, radio communication is the most attractive solution in order to provide a flexible system. In prior art systems of this kind, the vehicle detector 10 is provided with an internal antenna or an antenna provided at the outer surface of the vehicle detector 10. The vehicle detector 10 communicates 3 via the antenna with an access point 51 provided relatively close to the roadway. In order to reduce the required power for the radio transmissions and to provide an as short transmission distance 6 within the soil as possible, the distance to the access point 51 is typically limited. Maximum distances of 30 meters have been mentioned. Since the access points 51 have to be provided close to the vehicle detectors 10, they can typically serve only one or a few of them located in a limited geographical area, typically less than hundred meters or a few hundred meters from the access point, which causes expensive systems. Furthermore, the access points 51 typically require power installations at the road side.

An alternative would be to communicate 2 with a more distant access point, e.g. a base station 50. However, the transmission distance 5 within the soil increases as well as the total distance, which requires higher transmitted power. This is often not compatible with battery powered vehicle detectors 10.

An increased flexibility and suitability for intermittent usage of a vehicle detector is provided by enabling a long-range radio connection for a vehicle detector placed in a suitable detection position by means of low power solutions. The limitation of power requirements can be obtained by different approaches. It is by the present invention realised that the power requirements of the radio connection play an important role in the total power requirement. One approach to reduce the power requirements for the radio connection is to provide a radio connection that requires a low transmitting power. This can be achieved by providing an antenna with good radio conditions relative to a base station or other access point of the communication system with which the vehicle detector is intended to communicate. Another approach is to provide an operation scheme that reduces the periods during which the radio connection, and thereby the transmitter and receiver, is active. Most preferably, both approaches are combined.

Figure 1B:
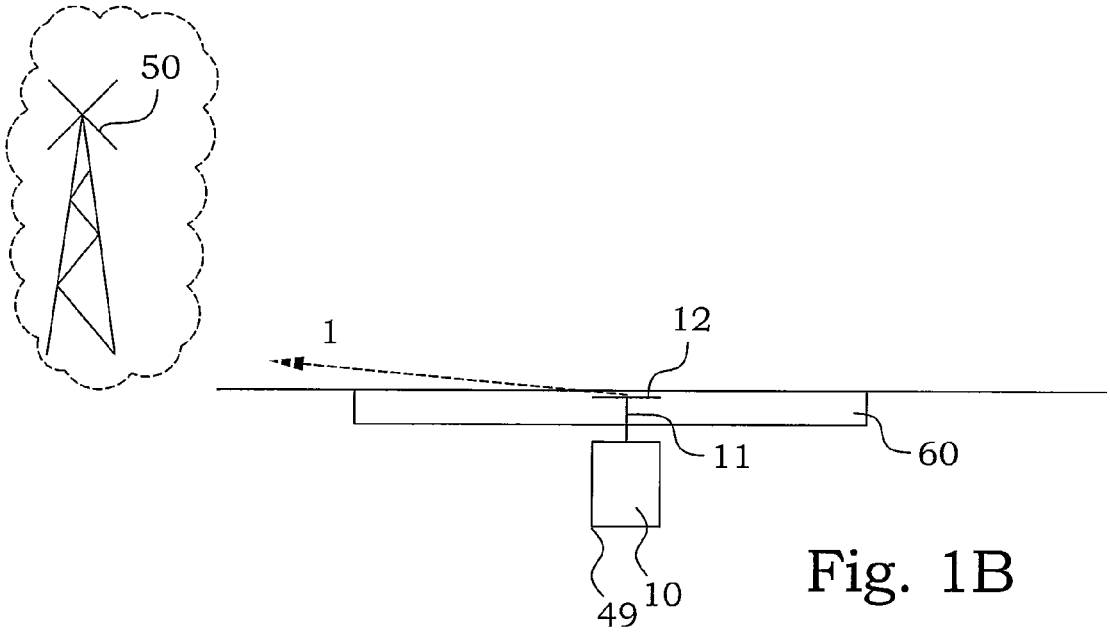
FIG. 1B is a block diagram of an embodiment of a part of a vehicle detector system according to the present invention.

FIG. 1B illustrates a vehicle detector 10 according to the present invention provided in a similar situation. The vehicle detector 10 encloses most of its components within a housing 49. However, an antenna 12 is provided at a distance from the housing 49, connected to the housing via a cable 11. The distance is long enough to enable the antenna 12 to be positioned within the roadway surface coating 60, typically close to the surface of the roadway surface coating 60. The distance between the surface of the roadway surface coating 60 and the antenna 12 is less than the distance between the antenna 12 and the housing 49, preferably significantly less. In other words, a ratio between the distance between the surface of the roadway surface coating 60 and the antenna 12 and the distance between the antenna 12 and the housing 49 is smaller than 1, preferably smaller than ⅓ and most preferably smaller than 1/10. Via the antenna 12, the vehicle detector 10 can communicate 1 with a relatively distant base station 50, and since the transmission path through the soil is short, the required transmission power is relatively moderate. Furthermore, the antenna 12 and cable 11 are possible to manufacture as mechanically weak structures, which do not cause any damage to e.g. road-making machines, when mechanically interacting therewith.

Figure 2:
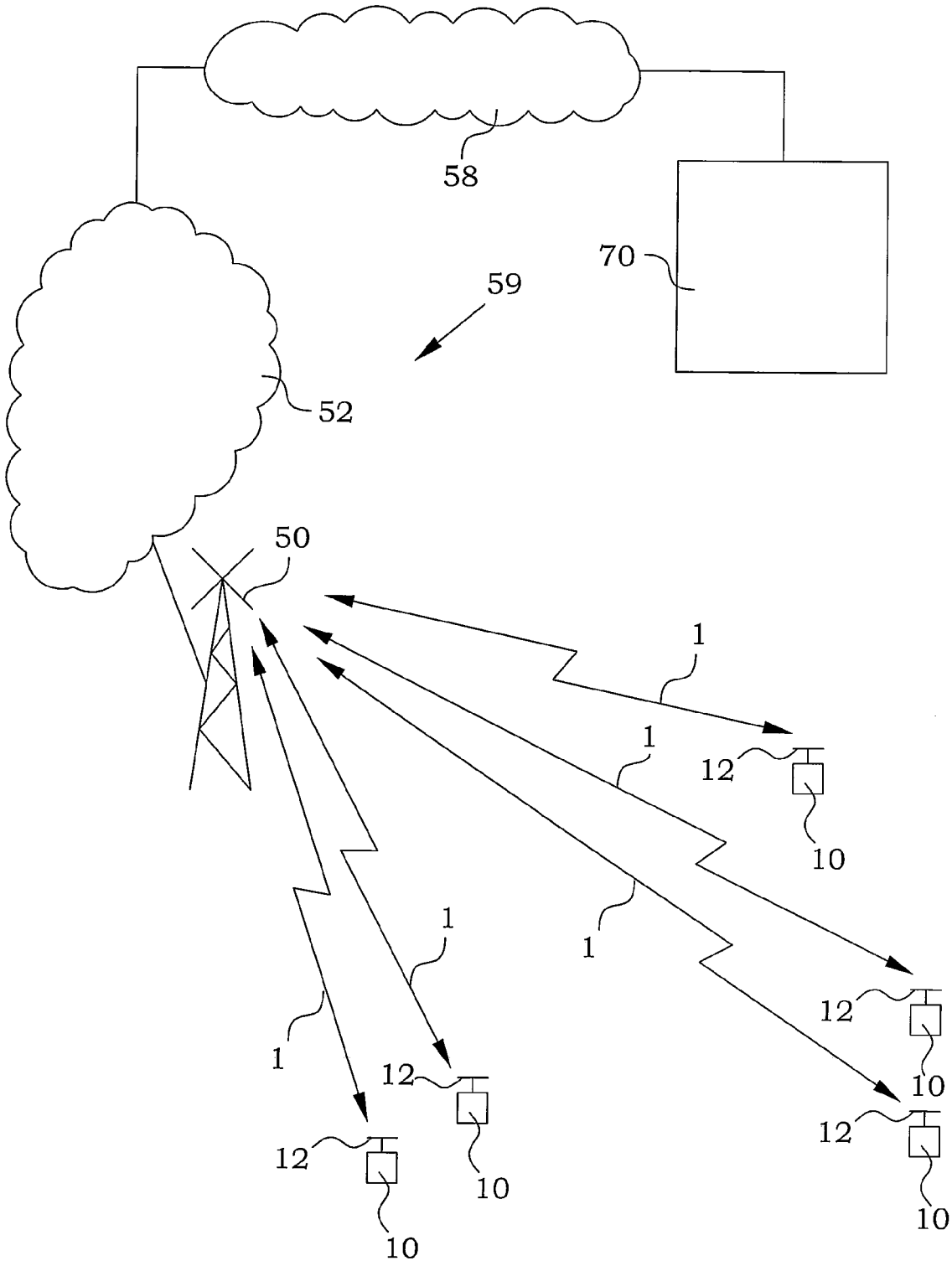
FIG. 2 is a schematic illustration of information flow in an embodiment of a vehicle detector system according to the present invention.

FIG. 2 illustrates a system of vehicle detectors 10. A multitude of vehicle detectors 10 communicates 1 with a base station 50 (or a number of base stations). The base station 52 is a part of a cellular communication system 59 and is connected to a core network 52. The core network 52 is further connected to other stationary or mobile communication systems or networks, e.g. using different Internet 58 connections. A traffic surveillance node 70 is connected to the core network 52, possibly via e.g. an Internet connection. Each vehicle detector 10 has thereby the possibility to connect to the traffic surveillance node 70.

The use of base stations of a cellular communication network for communication directly with the vehicle detectors has several advantages. The installation of vehicle detectors is simple. In one embodiment, the vehicle detectors are just placed under ground, e.g. by drilling a hole in the roadway surface coating, placing the vehicle detector in place and then repair the hole, while holding the antenna within the roadway surface coating. Since the vehicle detector is battery driven and no additional access point has to be provided close to the vehicle detector, no installation of power facilities is necessary. Moreover, there no visible parts that could be exposed for damages. If the vehicle detector is requested to be inactive during a certain period, there is no need for removing it or protect it from wear. Since all communication takes place through the cellular communication network, no hardware configuring is necessary. Any configuration that might be necessary for surveillance purposes can be arranged for directly in the traffic surveillance node.

In applications directed e.g. to pure traffic counting, a common scenario is that the vehicle detectors are requested to operate for a certain period, and then be idle for a long period before the next measurement period. In such cases, approaches to reduce the active time of the radio connection are beneficial. The vehicle detectors can during inactivity periods be instructed to shut off all functionalities except for the re-activation. Functionalities that are not necessary to operate are e.g. communication functionalities, and the vehicle detectors can be completely disconnected from the cellular communication network. When the vehicle detectors are to be active again, the cellular communication network provides random access channels, which the vehicle detectors can use for re-establishing the contact again. In such a manner, functionalities of the cellular communication network, which originally were intended for mobility purposes are here instead used for allowing an easy disconnect and connect procedure. Furthermore, today there is a relatively good area coverage by the commercial cellular communication networks, which means that vehicle detectors can be placed almost anywhere without bothering about radio conditions.

Also, in cases where the vehicle detectors in fact are moved to new positions, the roaming facilities of the cellular communication system takes care of any reconfiguration of the actual radio contacts. This makes the setup extremely flexible.

Figure 3:
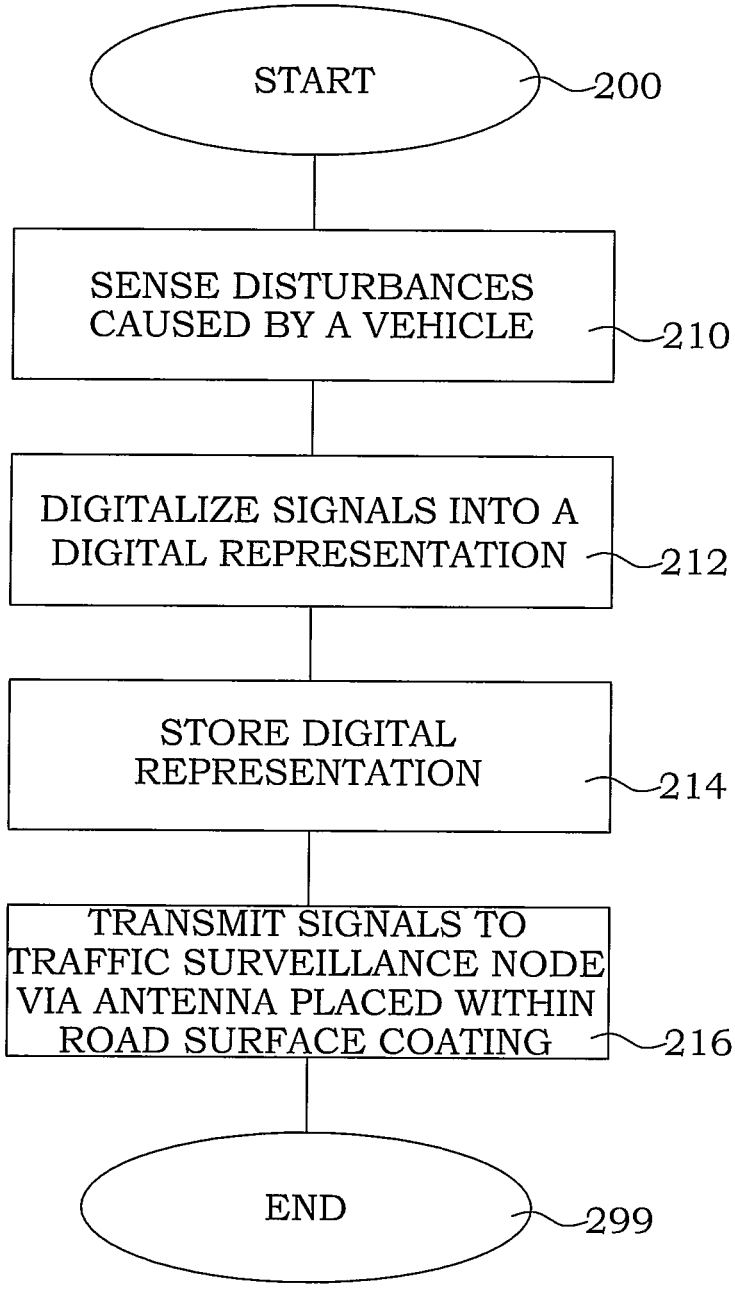
FIG. 3 is a flow diagram of steps of an embodiment of a method according to the present invention.

FIG. 3 illustrates a flow diagram of steps of an embodiment of a method according to the present invention. The method for providing traffic information starts in step 200. In step 210, disturbances caused by a vehicle are sensed. The signals of the disturbances are digitalized in step 212 into a digital representation. The digital representation is stored in step 214. The steps of sensing 210, digitalizing 212 and storing 214 are performed in a device placed under ground. In step 216, signals are transmitted to a traffic surveillance node by use of radio signals. The step of transmitting in turn comprises the step of providing the signals to be transmitted over a distance to an antenna placed within a roadway surface coating. The procedure ends in step 219.

In applications, where the vehicle detectors are used intermittently, e.g. for traffic counting purposes, the duration of the battery can be prolonged if sections of the vehicle detector are shut off during inactivity periods. According to preferred embodiments, at least the communication functionalities are allowed to be completely shut off during inactivity periods. This reduces the power requirements further compared to solutions where the communication functionalities only are put into an idle mode. In embodiments where the communication is totally shut off, one has to assign the vehicle detector to be responsible for at least the initiation of the re-activation of the communication. Since the vehicle detector is not continuously connected to the communication network during the inactivity periods, external re-activation instructions cannot be received.

Figure 4:
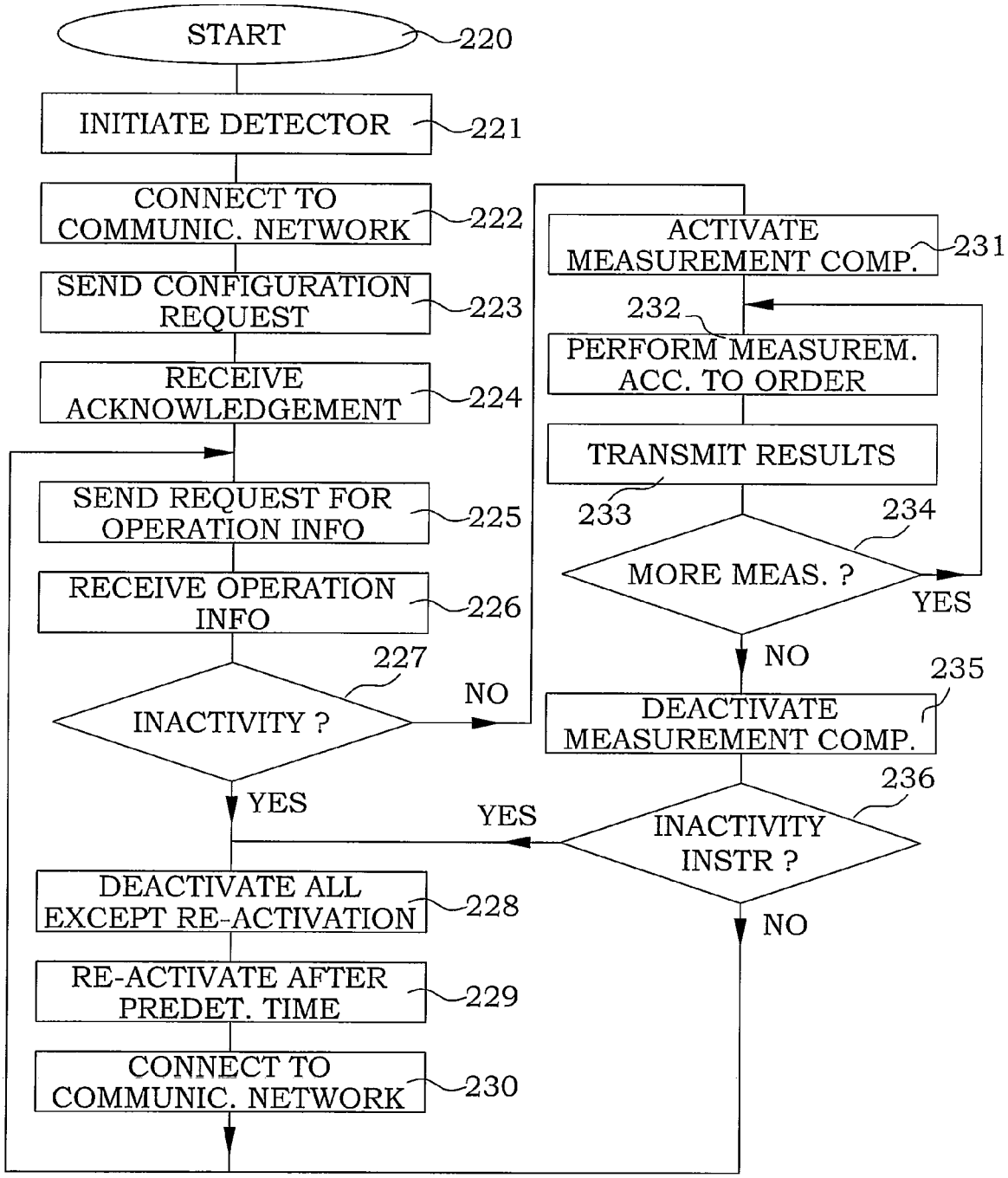
FIG. 4 is a flow diagram of steps in an embodiment of a traffic surveillance method according to the present invention.

One embodiment of how such a communication approach can be constructed is illustrated in FIG. 4. The procedure starts in step 220. In step 221, a vehicle detector is initiated. A battery, preferably freshly charged, is installed and all internal processes are started. In step 222, the communication parts of the vehicle detector, i.e. the transmitter and receiver, are activated in order to connect to the cellular communication system. This is preferably initiated by searching for a random access channel of the cellular communication system for establishing a first contact, according to a standard for the cellular communication system. An initiation message is sent in step 223 via the cellular communication system to a traffic surveillance node, reporting that the vehicle detector, with a certain identity number, is in operation. Here, additional information regarding approximate position, available sensor hardware etc. can also be reported. The initiation message can be provided as a data packet, e.g. utilizing GPRS functionalities. The traffic surveillance node utilizes the received information for configuring the vehicle detector into the surveillance system, and replies with an acknowledgement message. This acknowledgement message is received in step 224. The vehicle detector is now ready for operating. The steps 221 to 224 can be performed before or after the actual positioning of the vehicle detector under ground.

When the vehicle detector is placed in its intended position below the roadway and is ready for operation, an order requesting message is sent to the traffic surveillance node in step 225. The traffic surveillance node replies in step 226 with instructions for the intended future operation of the vehicle detector. These instructions that the vehicle detector receives may comprise measurement orders, e.g. specifying a measurement time period and types of measurements, or may comprise a simple order of being inactive until a predetermined instant. In an alternative embodiment, such instructions could also be included e.g. already in the initiation acknowledgement message. In step 227, it is checked whether or not the received instructions comprises an order of immediate inactivity. If no such inactivity order is received, the procedure continues to step 231.

If the vehicle detector has received an inactivity order until a predetermined instant, the process continues to step 228, in which most of the processes in the vehicle detector are inactivated and corresponding components preferably disconnected from the power supply. In other words, activities of performing of the sensing of disturbances, the digitalizing of signals, the storing of the digital representation, the transmitting of signals and the receiving of signals are disabled during a predetermined inactivity period. Preferably, only functionalities for initializing the future re-activation processes and the system clock are maintained powered and active. This inactivity state of the vehicle detector continues as long as the inactivity order has determined, i.e. until the pre-determined instant. This removes the need for any external interaction. The power consumption during this phase can thus be extremely small. The inactivity period can be very different in length, depending on the specific application, from some minutes to several years. During this period, no external unit can communicate with the vehicle detector.

When the predetermined time instant has been reached, the re-activation is initialized in step 229. In this embodiment, only the transmitter and receiver units are re-activated initially, while the components only involved in measurements and reporting of such still can continue being de-activated. In step 230, the communication parts of the vehicle detector, i.e. the transmitter and receiver are connecting to the cellular communication system. This is in analogy with the initial process preferably initiated by searching for a random access channel of the cellular communication system for establishing a first contact. The vehicle detector is now ready for receiving new instructions and the process returns to step 225. A transmitting of a request for further instructions when the inactivity period is ended is thus performed.

If, in step 227, it is determined that no immediate deactivation is to be performed and some sort of measurement order instead is to be performed, the process continues to step 231, where the components concerning measurements and processing thereof, e.g. sensor, digitizer, memory etc., are powered and activated. Performance of sensing disturbances, digitalizing signals and storing the digital representation are thus enabled in response to received measurement instructions. In a particular embodiment, the vehicle detector will disconnect from the cellular communication system during such measurement periods, in order to save battery power and the transmitter and receiver can even be shut off. In other embodiments, the connection to the cellular communication system may be maintained. In step 232, measurements are performed and in step 233 the results thereof are reported to the traffic surveillance node. If the vehicle detector was disconnected from the cellular communication system during the measurement period, the vehicle detector has to activate the transmitter and receiver and reconnect to the cellular communication system again before the reporting can be performed. The type of measurements as well as the format and timing of the reports are preferably defined already by the measurement order. If the measurement time is so large that the memory becomes filled, additional reporting occasions are preferably arranged for. In step 234, it is checked whether or not the measurements are to continue. If more measurements are ordered, the process returns to step 232 and the transmitter and receiver may again be disconnected and shut off.

In a particular embodiment, if the measurement activity is very low, which for instant may be the case during nights, the components concerning the measurements can be set into an idle state when not being used. This idle state reduces the needed power, but the components concerning the measurements can very quickly be brought into an active state again. By having an additional alert sensor, e.g. a vibration sensor, which is very low-energy consuming, such a sensor can initiate a procedure to bring back the components concerning the measurements from the idle state when a vehicle is approaching.

If, in step 234, it is concluded that no more measurements are ordered in the latest received information, the process instead continues to step 235, where the components concerning measurements and processing thereof are deactivated and un-powered. The process continues to step 236, where it is checked whether or not the latest information comprised any order of inactivity in connection with the end of the measurements. If such an inactivity order specifying a predetermined ending time instant was included, the process continues to step 228 for another inactivity period. If no inactivity order has been received, the process instead returns to step 225 for requesting further instructions.

The fact that the vehicle detector itself is responsible for the reactivation enables an extremely low-power deactivated state of the vehicle detector. The drawback is that the deactivated state cannot be interrupted from exterior. However, since the deactivated state is so power efficient, one can instead allow the vehicle detector to become activated relatively frequently for investigating if any measurements are to be performed, even if most of the requests then are answered by a new inactivity order.

The above described flow diagram is only one example of how an operating principle of a vehicle detector could be implemented. As anyone skilled in the art understands, there are virtually unlimited other possible variations. The type of messages can be different. For instant, it could be decided beforehand that the received order only contains one single order, either a measurement order or an inactivity order. The procedure flow can then be somewhat simplified, but may be slower and may require more signalling. How the measurements should be performed and reported could also be defined e.g. in connection with the initiation, and only the time for the measurements are determined by the received information. In further alternatives, more than one measurement session with inactivity period inbetween could be defined, which further reduces the need for communication of requests and orders. In an extreme case, all the future operation could be instructed upon initiation and no other communication than the reporting of the measurement results is necessary. Such initial instruction could also be performed either via the cellular communication system or by e.g. providing a memory of the vehicle detector with such information before the vehicle detector is put into position.

In alternative embodiments, though not presently considered as preferred ones, the vehicle detector could also be configured to be activated by external means. One possibility is to let the vehicle detector not be completely disconnected from the cellular communication system during the inactivity periods and thereby still be reachable by e.g. different kinds of paging signalling. However, most such solutions require higher power consumption which then reduces the life time of the battery.

Figure 5:
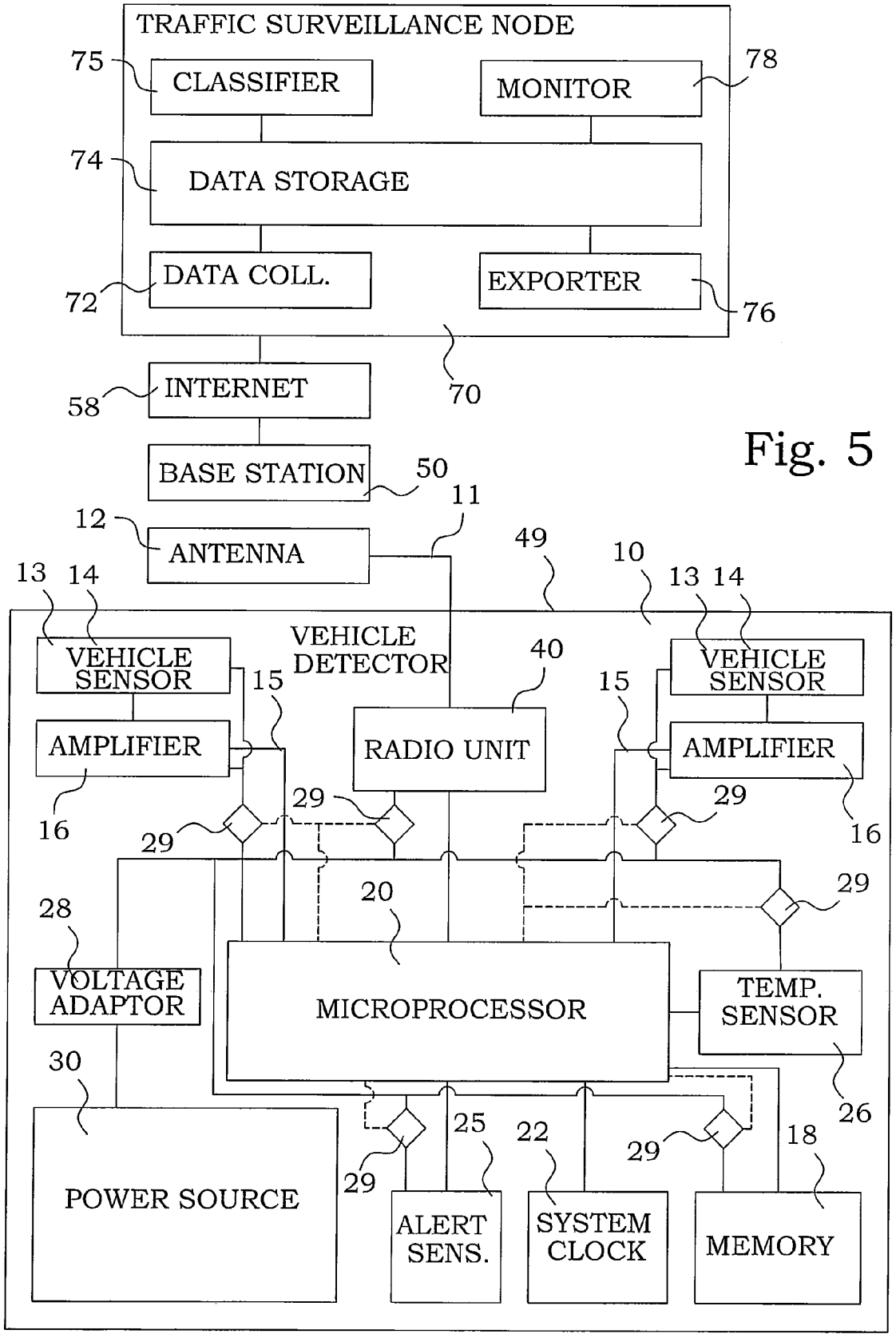
FIG. 5 is a block diagram of an embodiment of a vehicle detector system according to the present invention.

A traffic surveillance system according to an embodiment of the present invention is illustrated as a block diagram in FIG. 5. The vehicle detector 10 has, as described further above, a housing 49, inside which most of the functionalities are comprised. The housing 49 provides protection against mechanical damage and moisture for the components inside the housing 49. The antenna 12 is at the contrary provided at a distance from the housing 49 connected by a cable 11 for enabling placement of the antenna 12 within a roadway surface coating.

The core of the vehicle detector 10 of the present embodiment is a microprocessor 20. The microprocessor 20 is connected 15 to two vehicle sensors 14, in this embodiment magnetometers 13, via a respective amplifier 16. The magnetometers 13 in this embodiment are 2-axis magnetometers, but other types of magnetometers or magnetometer arrangements can also be used depending on the type of information that is requested. The vehicle sensors 14 are arranged for sensing disturbances caused by a vehicle, e.g. disturbances in the earth magnetic field. The vehicle sensors can in other embodiments be of other types, e.g. vibration sensors, sound sensors or RFID readers. In this embodiment, the vehicle detector 10 comprises two vehicle sensors 14. However, in other embodiments, the number of vehicle sensors 14 is different depending e.g. on the particular application. At least one vehicle sensor 14 is, however, necessary. The additional vehicle sensor 14 could be utilized either as redundant equipment or for measuring different aspects of vehicle induced indications. If sensors 14 are positioned at different positions in the direction of the intended vehicle motion, speed information can more easily be achieved. The different vehicle sensors 14 could be of the same or different kinds. For instance, a magnetometer 13 could be combined with an RFID reader.

The measurement signal is provided from the vehicle sensors 14 to the processor 20, which comprises a digitizer. The digitizer is arranged for encoding the signal from the vehicle sensor into a digital representation. The digital representation of the signal is then stored in a memory 18 connected to the digitizer. The microprocessor 20 is further connected to a system clock 22 and an alert sensor 25. These components are the main responsible components for keeping a reliable system time and the recalling the vehicle sensors from an idle state. The microprocessor 20 is also connected to a radio unit 40, comprising a transmitter and a receiver. The radio unit 40 is preferably adapted for communication using a GSM and/or GPRS standard. The radio unit 40 is further connected to the antenna. The microprocessor 20 further comprises a controller arranged for controlling operation of the vehicle sensors, the digitizer, the memory and the transmitter. The microprocessor 20 is further connected to a temperature sensor 26. The microprocessor 20 can thereby compensate the measurements for temperature variations.

A power source 30, typically a battery, provides power to all components of the vehicle detector 10. A voltage adaptor 28 is responsible for providing a well controlled voltage to the different components of the vehicle detector 10. A number of controllable switches 29 are provided in the power lines of the temperature sensor 26, the vehicle sensors 14, the memory 18, the alert sensor 25 and the radio unit 40. These controllable switches 29 are individually controlled by the controller of the microprocessor 20, for disconnecting components during the inactivity periods. Only parts of the microprocessor 20 itself, the system clock 22 and the alert sensor 25 are left powered.

The vehicle detector 10 communicates via a base station 50, e.g. a GSM base station, and in this embodiment also via the Internet 58, with a traffic surveillance node 70. The traffic surveillance node 70 comprises in this embodiment a data collection server 72, which is responsible for the communication with the vehicle detectors. Typically, the data collection server 72 issues measurement instructions as well as receives measurement reports. The data collection server 72 is connected to a data storage 74, in which reported measurements are stored. A classifier 75 is connected to the data storage 74 and processes the data therefrom for providing information about e.g. the number of passing vehicles, or, if more sophisticated analysis methods are utilized, e.g. the type of vehicle etc. The results from such evaluations are presented at a presentation monitor 78 or can be exported to other computer systems by a data exporter 76. The data collection server 72 may in alternative embodiments have other configurations. The data collection server could e.g. be configured as a distributed system of a number of communicating servers, where e.g. one server is responsible for the actual data collection and another server is responsible for classification and other data evaluation. The communication between such servers may also be performed via Internet or other types of general communication systems. In other embodiments of the traffic surveillance node 70 some components may be omitted, e.g. the monitor and/or data exporter 76.

Figure 6:
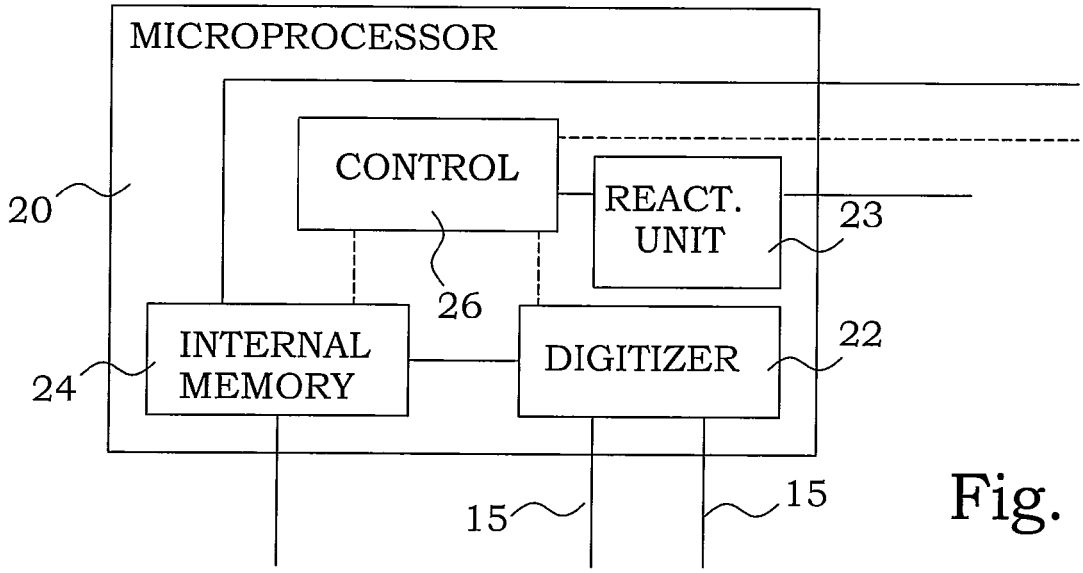
FIG. 6 is a block diagram of an embodiment of a microprocessor used in FIG. 5.

FIG. 6 illustrates an embodiment of a microprocessor 20 according to FIG. 5. The microprocessor 20 comprises a digitizer 15 connected to the different vehicle sensors 14. An internal memory 24 is provided for storing smaller amounts of data, while larger data amounts are provided to the memory 18 (FIG. 5). A controller 26 is provided for turning off the vehicle sensors, the digitizer, the memory, the alert sensor and the radio unit (the transmitter and the receiver) during a predetermined inactivity period and for activating the radio unit (the transmitter and the receiver) in order to transmit a request for further instructions when the inactivity period is ended. The controller 26 is further arranged for powering the vehicle sensor, the digitizer, the memory and the alert sensor if measurement instructions are received. The controller 26 is in this embodiment also responsible for controlling the transmitting of digital representations from the memory to traffic surveillance node. As will be discussed further below, the digital representations are preferably digital representations of entire signal shapes of the signals provided by the vehicle sensors. The microprocessor 20 also comprises a reactivation unit 23, responsible for initiating the reactivation of the vehicle detector or parts thereof when the inactivity period is over. The reactivation unit 23 is therefore connected to the system clock for having access to a reliable time. Preferably, the reactivation unit 23 is at least to a part separated from the other functionalities in the microprocessor 20 so that parts responsible for the functionalities not being used for the reactivation unit may be turned off or at least be put in a low-power consumption state during the inactivity periods. In other embodiments, where the inactive microprocessor 20 has a very low overall power consumption, the entire microprocessor 20 can be kept functionable also during inactivity periods.

The different components illustrated in FIG. 6 are typically integrated into one physical unit, whereby the blocks merely indicate differences in functionality.

Figure 7:
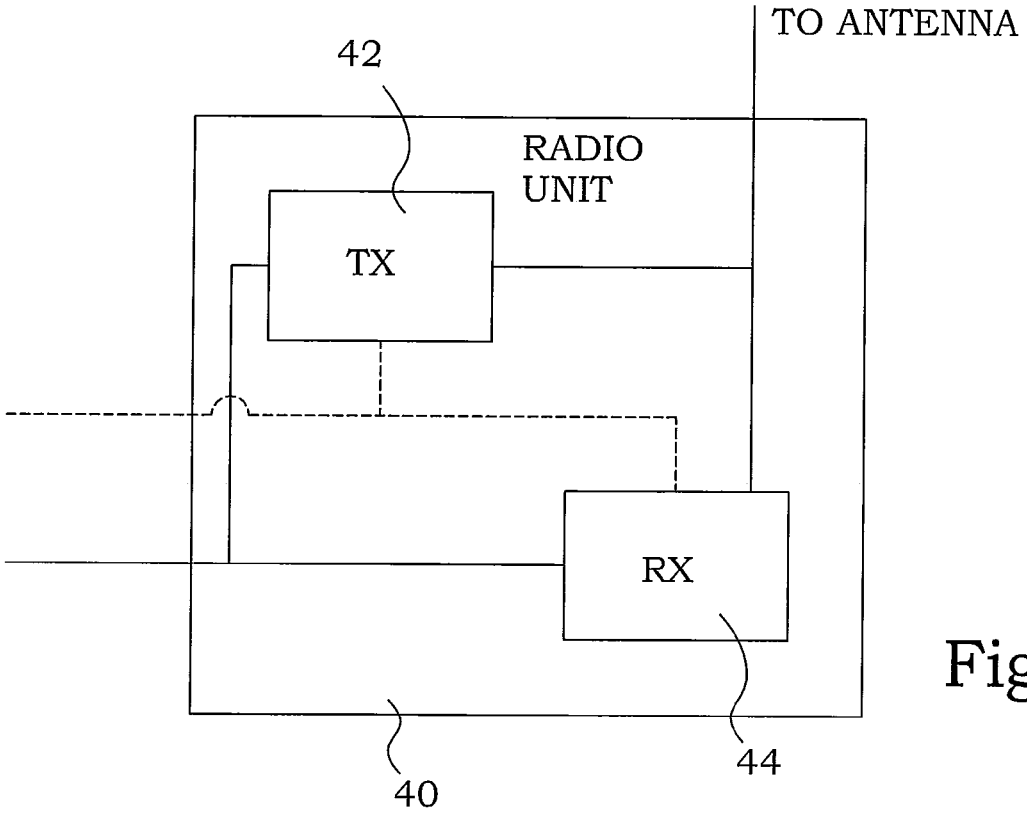
FIG. 7 is a block diagram of an embodiment of a radio unit used in FIG. 5.

FIG. 7 illustrates a block diagram of an embodiment of a radio unit 40 according to the FIG. 5. The radio unit 40 comprises a transmitter 42 and a receiver 44, both utilizing the same antenna. The operation of these parts is in this embodiment controlled by the controller of the microprocessor.

Figure 8A:
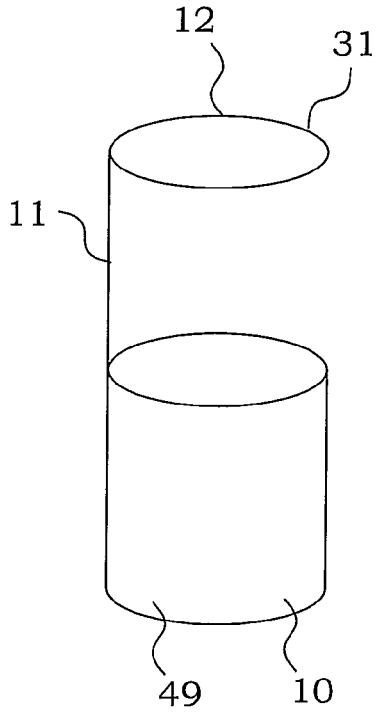
FIGS. 8A-E are schematic illustrations of a few examples of possible embodiments of antenna and recharging arrangements in connections with vehicle detectors according to the present invention.

When a vehicle detector according to the present invention is to be placed in measurement position, it is typically done after the completing of the roadway surface coating. A typical procedure is then to drill a hole in the surface coating, and if necessary a distance below the surface coating. The hole diameter is preferably made just large enough to admit the housing to pass. The depth of the hole determines the position of the housing below the surface coating, and can be carefully adapted to give a good compromise between measurement sensitivity and damage protection. The preferable hole depth is presently believed to be in the range of 200-300 mm. The hole is then filled with material, preferably the same kind of material as is present laterally. In other words, in the area below the surface coating, a material being the same or similar as the road support layer is filled. Within the surface coating, the hole is filled with a material resembling the surface coating as good as possible. Preferably, the hole is filled with a material having mechanical properties similar to a roadway surface coating. The antenna is provided at the intended position within this filling material. An embodiment of a vehicle detector 10 is illustrated in FIG. 8A. A housing 49, preferably in a cylindrical shape contains most of the components, as described further above. An antenna 12, in this embodiment a loop antenna 31 is connected by a cable 11. The antenna is preferably designed to be a half wavelength antenna. The housing 49 is placed at the bottom of the drilled hole and the antenna 12 is kept within the surface coating when filling the hole.

Figure 8B:
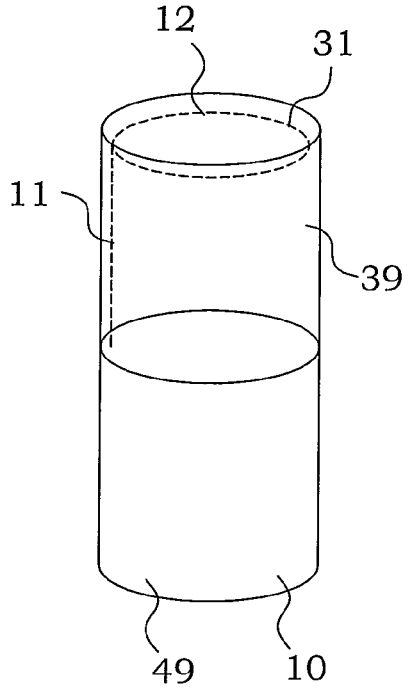

The vehicle detector unit can also be provided to facilitate the positioning. Such an embodiment is illustrated in FIG. 8B. The antenna 12 can already before the placement be provided within a volume 39 filled with a material having mechanical properties similar to a roadway surface coating into which the antenna 12 is intended to be placed. Examples of possible material are asphalt, bitumen or epoxy. The volume 12 is mechanically attached to the housing 49. A hole is drilled, which has the same depth as the height of the entire unit in FIG. 8B. The entire unit is placed at the bottom of the hole, ensuring that the top of the vehicle detector 10 does not protrude above the roadway surface coating. The cylindrical slit between the vehicle detector and the wall of the hole is filled, e.g. with materials that are used for repairing minor damages at the roads. This volume to be filled is typically much less than the volume of the hole and more expensive materials can typically be used. The volume 39 thus constitutes a part of the roadway surface coating when the slit has been sealed.

In an alternative embodiment, another volume of material could be added between the volume 39 and the housing 49. This additional volume could be filled with a material having vibration damping properties in order to reduce vibrations induced in the surface coating directly down to the housing 49.

Figure 8C:
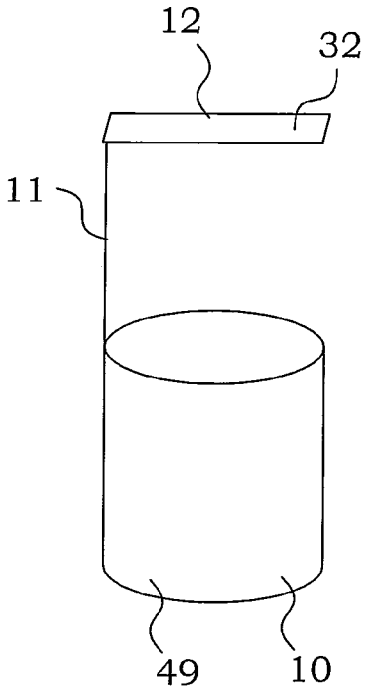

The antenna can be of different kinds. A loop antenna 31 was used in the embodiments of FIGS. 8A and 8B. FIG. 8C instead illustrates an embodiment of a vehicle detector 10, having an antenna 12 provided at a meandering antenna on a flexible plastic substrate 32. Since the technical effect of the present invention typically is not determined by the actual choice of antenna, also other types of antennas are possible to use in the present invention.

Figure 8D:
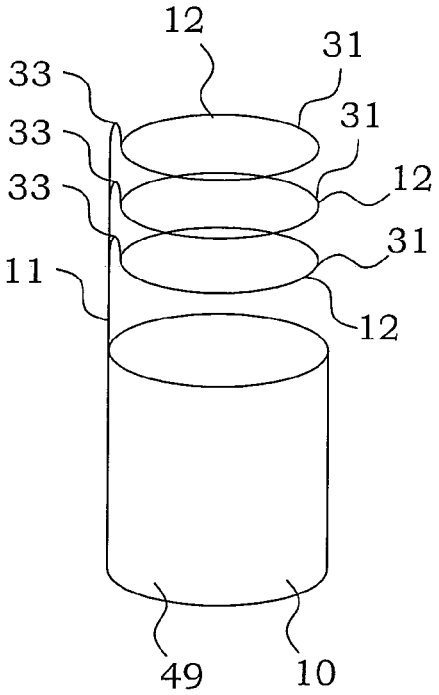

As mentioned further above, the antenna of the vehicle detector is provided within the roadway surface coating. However, the surface coating is not completely permanent. It is typically affected by wear and erosion. If the detector is positioned at such a place where the vehicle wheels pass, the roadway surface coating will gradually be worn off, and eventually, the antenna may appear at the very surface of the road. This process can also be enhanced e.g. by use of road scrapers for removing ice and snow during the winter season. The antenna may therefore be damaged and may eventually cease to operate properly. In FIG. 8D, an embodiment of a vehicle detector 10 comprises a plurality of antennas 12, in this particular embodiment exemplified by loop antennas 31. The plurality of antennas 12 are all provided outside the housing 49. The distance of each antenna from the housing 49 is designed for enabling placement of the plurality of antennas 12 at different depths within a roadway surface coating. Possibly, for facilitating the positioning of the antennas, they may be provided in a pre-moulded volume in analogy with FIG. 8B. With such a structure, when the wear of the roadway surface coating has reached the level of the highest antenna, this antenna may be destroyed. It is then, however, possible to switch to the next antenna and continue the operation.

In order to have a relatively well determined disfunctionalising of the antenna, the cable to each antenna preferably is provided with a cutting bow 33 which has its most upper part above the level of the main antenna. This means that the cutting bow 33 will be worn off before the actual antenna is affected. The antenna can thereby be trustfully operated all the time until the cutting bow 33 is removed.

When having a multitude of antennas, the vehicle detector should preferably autonomously be able to select which one of the antennas to use. Therefore, it is preferred if the vehicle detector is arranged for determining which is the antenna having the best radio conditions relative the base station. This is typically the highest positioned operable antenna out of the plurality of antennas having possible connections to be used for the transmission. The transmission from the vehicle detector should then be controlled to utilise that antenna having the best radio conditions. In the vehicle detector, this is preferably performed by the controller, which accordingly is arranged to determine an antenna of the plurality of antennas having a best radio conditions relative the base station and to control that antenna for transmissions.

The above embodiment is also suitable for roads being recoated. When the uppermost part of the still existing roadway surface coating is cut away to even out the roadway surface and to produce a surface that is suitable to repave, one of several of the antennas may be destroyed. However, a functional antenna may still exist in the remaining layer. The weak construction of the antenna also ensures that the road-making machine does not become damaged. When a new surface coating is provided, the functional antenna can be used for continue the communication. The small disadvantage is now that the antenna will be buried under the newly provided top surface coating and the transmitting power may have to be increased somewhat. However, the situation is anyway better than for an antenna being situated within the hosing of the vehicle detector.

Figure 8E:
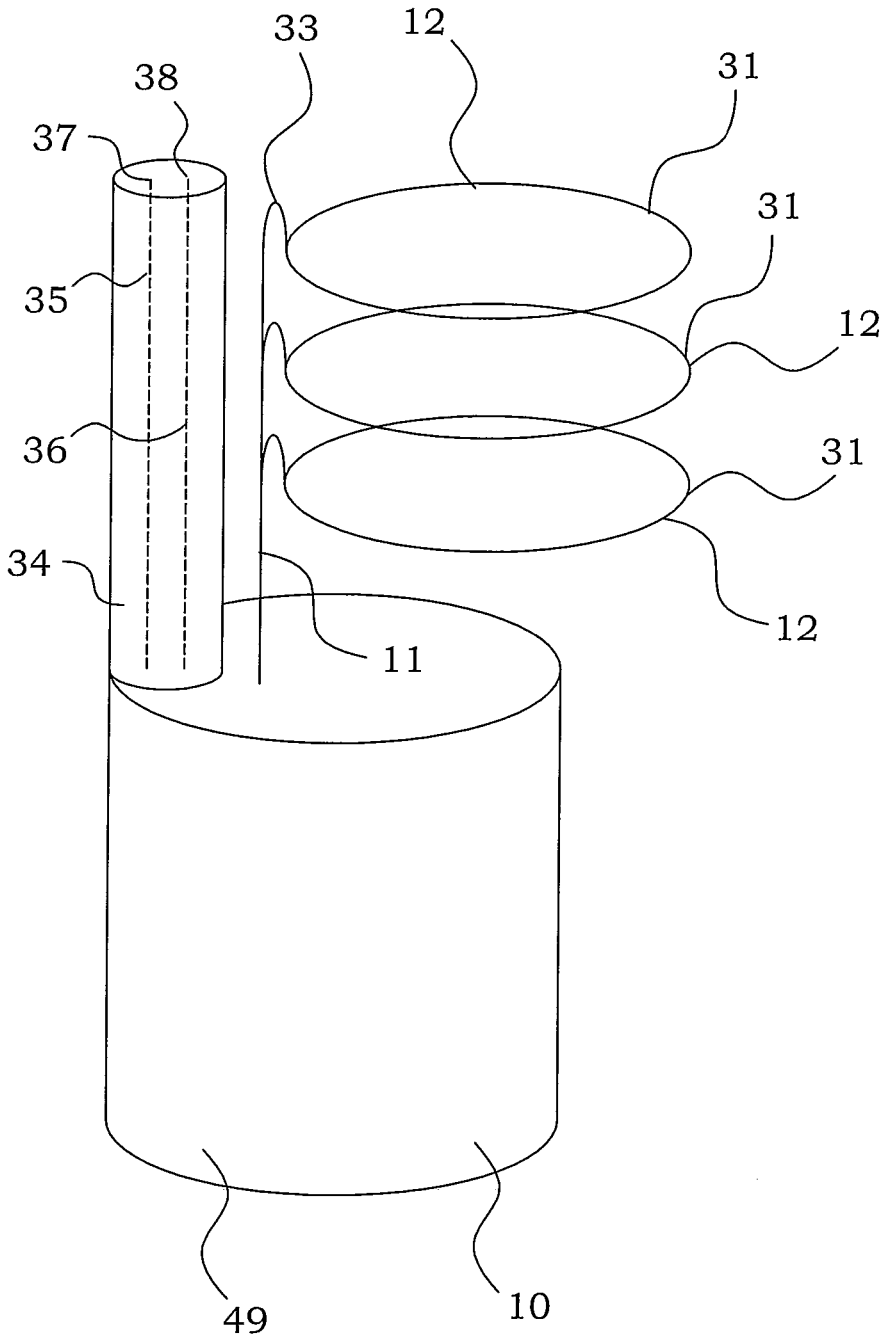

The power consumption of the vehicle detector is one of the limiting factors when designing the unit. With the latest development of battery technology and in applications where only intermittent measurements are to be performed, a life time of over 10 years would be possible to reach. However, the more frequent the use is and the more data that is to be transmitted, the shorter the battery will last. In FIG. 8E, an embodiment of a vehicle detector 10 comprises a recharging arrangement. A positive conductor 35 and a negative conductor 36 are provided from the housing 49 to the intended top of the roadway surface coating. The end of the positive conductor 35 constitutes a positive connection point 37 at the top of the roadway surface coating and the end of the negative conductor 36 constitutes a negative connection point 38 at the top of the roadway surface coating. The positive conductor 35 and the negative conductor 36 are preferably provided within a volume 34 of an erodable material with similar mechanical properties as the roadway surface coating. This volume could with advantage be integrated within a volume comprising the antennas, if such a volume is provided. When the surface coating is worn, the volume 34 and the conductors 35, 36 are worn in a corresponding fashion, always providing a positive connection point 37 and a negative connection point at the top of the roadway surface.

If a recharging of the batteries of the vehicle detector is necessary, a power supply could be attached to the positive connection point 37 and the negative connection point 38. If e.g. a solar cell is used as power supply, the connection could even be permanent. The controller within the housing 49 may then detect that a voltage is present between the conductors and initiate a recharging procedure. This could in certain embodiments be performed dependent on the status of the vehicle detector. However, in other embodiment, the recharging control could be totally separated from the other functionalities of the unit.

In a further embodiment, a temperature gauge could be included close to the position of the antenna, or at least in contact with the roadway surface coating. The temperature gauge could e.g. be included in the same volume 34 as the recharging conductors and/or in the same volume as moulded-in antennas. The temperature gauge can then be connected to the temperature sensor of the vehicle detector in order to give an even more reliable temperature of the roadway.

In applications for traffic counting, there are also often requests of being able to distinguish between different kinds of vehicles. In provisional experiments utilizing magnetometer based sensors, it has been found that the magnetic profiles measured as a function of time comprises a lot of detailed information. In most prior art systems utilizing magnetometer based measurements, the amount of data is heavily compressed in order to reduce the amount of data to be transmitted. However, by doing such data compressions, a lot of information is lost. In order to be able to sense as much details as possible regarding the magnetic signature of the vehicles passing the detectors, it is preferred to place the vehicle detector straight beneath the path of the vehicles. In a typical road, the sensors should therefore be placed between the intended tracks for the respective wheels.

The depth of the sensor is also of importance. According to the present invention, the sensor should be placed below the surface coating of the road, manly for reasons of wear and damage. However, if the vehicle detector is placed too deep, the road material will damp the measured magnetic profile. It is therefore presently considered preferable to place the vehicle detector at a maximum depth of 20 cm below the surface of the road. It is for the same reasons of benefit to have the actual sensor components placed in the top part of the housing, while e.g. batteries and controller can be placed in the bottom of the housing.

By positioning of the sensor according to the above principles, measurements of very accurate magnetic profiles are possible. Not only the number of vehicles passing the detector and perhaps the associated vehicle length, but also information regarding number of wheel axes, the vehicle "magnetic mass", which typically is related to the vehicle weight, the speed of the vehicle, the length of the vehicle and the travel direction is possible to detect.

In a preferred embodiment of the present invention, detailed data from the vehicle sensors are therefore stored in a data storage in the vehicle detector as digital representations of entire signal shapes of signals of the sensed disturbances. When the measurements are finished, these digital representations of entire signal shapes are transmitted to the traffic surveillance node. In the traffic surveillance node, a database with original signal shapes from the individual sensors is collected. An advanced analysis of the signal shapes can thereby be provided, since large computational power can be provided without having to comply with battery saving considerations. Raw data can also be exported from the database for external analysis. It is believed that the power needed for transmitting the increased amount of data to a certain degree is compensated by better possibilities for an energy efficient handling of the signals themselves. Furthermore, the access to the entire signal shapes opens up completely new applications for automated traffic surveillance.

Pattern recognition routines are presently being developed very fast, to a part as a result of the higher processing power now available for a relatively low cost. By also utilizing neural network approaches, self learning systems can be built, improving e.g. classification of vehicle classes etc. It is believed that already today, it would be possible to distinguish between a private car, a private car with a trailer, a 2-axle truck, a 2-axle truck with a trailer, a 3-axle truck and a 3-axle truck with a trailer. Furthermore, velocity determinations with an accuracy of better than 2.5 km/h are also believed to be possible already today.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. Vehicle detector, comprising:

a vehicle sensor arranged for sensing disturbances caused by a vehicle;

a digitizer connected to said vehicle sensor and arranged for encoding a signal from said vehicle sensor into a digital representation;

a memory connected to said digitizer and arranged for storing said digital representation;

an antenna;

a transmitter connected to said memory and said antenna;

a controller arranged for controlling operation of said vehicle sensor, said digitizer, said memory and said transmitter;

a battery powering said vehicle sensor, said transmitter and a receiver;

and a housing enclosing said vehicle sensor, said digitizer, said memory, said transmitter and said controller;

said housing providing protection against mechanical damage and moisture for said vehicle sensor, said digitizer, said memory, said transmitter and said controller, thereby enabling said housing to be placed under ground;

said antenna is provided outside said housing and at a distance from said housing for enabling placement of said antenna within a roadway surface coating;

said controller is arranged for turning off at least one of said transmitter, said receiver, and said vehicle sensor during a predetermined inactivity period and for activating said transmitter and said receiver and transmitting a request for further instructions when said inactivity period is ended; and said controller is arranged for cowering said vehicle sensor when measurement instructions are received as said further instructions.

2. Vehicle detector according to claim 1, wherein a receiver, which together with said transmitter is arranged for communication with a cellular communication system.

3. Vehicle detector according to claim 2, wherein said cellular communication system provides a random access channel.

4. Vehicle detector according to claim 3, wherein said controller is arranged for controlling communication with a traffic surveillance node via said cellular communication system.

5. Vehicle detector according to claim 3, further comprising a plurality of antennas provided outside said housing and at a distance from said housing for enabling placement of said plurality of antenna at different depths within the roadway surface coating.

6. Vehicle detector according to claim 2, wherein said controller is arranged for controlling communication with a traffic surveillance node via said cellular communication system.

7. Vehicle detector according to claim 6, further comprising a plurality of antennas provided outside said housing and at a distance from said housing for enabling placement of said plurality of antenna at different depths within the roadway surface coating.

8. Vehicle detector according to claim 2, further comprising a plurality of antennas provided outside said housing and at a distance from said housing for enabling placement of said plurality of antenna at different depths within the roadway surface coating.

9. Vehicle detector according to claim 1, further comprising a plurality of antennas provided outside said housing and at a distance from said housing for enabling placement of said plurality of antenna at different depths within the roadway surface coating.

10. Vehicle detector according to claim 9, wherein said controller is arranged to determine an antenna of said plurality of antennas having best radio conditions relative to a base station of said cellular communication system and to control said transmitter to utilise said antenna having best radio conditions relative to a base station of said cellular communication system for transmissions.

11. Vehicle detector according to claim 1, wherein at least one antenna is provided within a volume filled with a material having mechanical properties similar to the roadway surface coating into which said antenna is intended to be placed, said volume being mechanically attached to said housing.

12. Method according to claim 11, where the predetermined inactivity period is specified in inactivation instructions received as said further instructions.

13. Vehicle detector according to claim 1, where the predetermined inactivity period is specified in inactivation instructions received as said further instructions.

14. Vehicle detector according to claim 1, where said controller is arranged for turning off the vehicle sensor during the predetermined inactivity period.

15. Method for providing traffic information, comprising the steps of:

sensing disturbances caused by a vehicle;

digitalizing signals of said disturbances into a digital representation;

storing said digital representation; and transmitting signals to a traffic surveillance node by use of radio signals;

said steps of sensing, digitalizing and storing are performed in a device placed under ground;

said step of transmitting comprises the step of providing said signals to be transmitted over a distance to an antenna placed within a roadway surface coating, disabling performing of said steps of sensing disturbances, transmitting signals and receiving signals during a predetermined inactivity period;

performing said step of transmitting signals and transmitting a request for further instructions when said inactivity period is ended; and re-enabling performing of said step of sensing disturbances in response to receiving measurement instructions as said further instructions.

16. Method according to claim 15, comprising the further step of receiving signals from said traffic surveillance node, said step of transmitting and said step of receiving are performed according to a cellular communication system standard.

17. Method according to claim 15, comprising the step of initiating said step of transmitting a request for further instructions by sending a request on a random access channel of said cellular communication system.

18. Method according to claim 15, wherein said step of transmitting signals comprises transmitting of retrieved said digital representations to said traffic surveillance node, said digital representations being digital representations of entire signal shapes of signals of said sensed disturbances.

19. Method according to claim 15, where said sensing is performed with a vehicle sensor.

20. Method according to claim 19, where disabling performing the step of sensing disturbances includes turning off the vehicle sensor.

* * * * *

UNITED STATES PATENT AND TRADEMARK OFFICE

CERTIFICATE OF CORRECTION

PATENT NO. : 8,773,287 B2
APPLICATION NO. : 13/055789
DATED : July 8, 2014
INVENTOR(S) : Fredrik Zettergren et al.

It is certified that error appears in the above-identified patent and that said Letters Patent is hereby corrected as shown below:

IN THE CLAIMS:

Claim 1, at column 15, line 4, change “cowering” to --powering--.

Claim 12, at column 16, line 1, change “claim 11” to --claim 15--.

Signed and Sealed this
Second Day of December, 2014

Michelle K. Lee

Michelle K. Lee
*Deputy Director of the United States Patent and Trademark Office*